US005850715A

United States Patent [19]

Francis

[11] Patent Number: 5,850,715

[45] Date of Patent: Dec. 22, 1998

[54] GROUND ANCHOR

[76] Inventor: Rex William Francis, Lot 27 Dunstan Rd., Avonsleigh, Australia

[21] Appl. No.: 687,560

[22] PCT Filed: Feb. 7, 1994

[86] PCT No.: PCT/AU94/00048

§ 371 Date: Aug. 7, 1996

§ 102(e) Date: Aug. 7, 1996

[87] PCT Pub. No.: WO95/21119

PCT Pub. Date: Aug. 10, 1995

[30] Foreign Application Priority Data

Jan. 28, 1994 [AU] Australia ..... 54790/94

[51] Int. Cl.[6] ..... E02D 5/80

[52] U.S. Cl. ..... 52/155; 52/166

[58] Field of Search ..... 52/155, 153, 154, 52/162, 163, 164, 166, 158, 159, 160, 161; 114/298, 304, 306, 307

[56] References Cited

U.S. PATENT DOCUMENTS

| | | | |
|---|---|---|---|
| 1,600,428 | 9/1926 | Robinson . | |
| 2,948,249 | 8/1960 | Gesner et al. | 114/298 |
| 3,012,644 | 12/1961 | Bush | 52/162 |
| 3,828,497 | 8/1974 | Vinycomb | 52/155 |
| 3,977,351 | 8/1976 | Watterback | 114/306 |
| 4,250,828 | 2/1981 | Cota | 114/306 |

FOREIGN PATENT DOCUMENTS

| | | | |
|---|---|---|---|
| 8702891 | 5/1992 | Australia . | |
| 297703 | 1/1989 | European Pat. Off. | 114/298 |

*Primary Examiner*—Michael Safavi
*Attorney, Agent, or Firm*—Thomas R. Vigil

[57] ABSTRACT

The ground anchor comprises two substantially triangular shaped plate members mounted to an elongate, substantially cylindrical member. The plate members are pivotably mounted on the elongate member so as to be selectively and pivotably moveable relate to the elongate member between a first or storage position, wherein the plate members abut or overlie one another, or a second or in-use position wherein the plate members extend away from one another.

16 Claims, 2 Drawing Sheets

GROUND ANCHOR

BACKGROUND OF THE INVENTION

1. Field Of The Invention

This invention relates to a ground anchor.

Throughout the ensuing description and claims reference will be made to an especially preferred embodiment of, the arrangement in accordance with the present invention, namely as and in a ground anchor. It should be realised, however, that the invention is not to be considered to be limited to such preferred embodiment and usage. Indeed, the arrangement in accordance with the present invention lends itself to usage in a variety of different contexts, in effect in any context or environment where an anchoring means is required.

2. Description Of The Prior Art

Off-road vehicles, such as 4-wheel drive vehicles, tractors and agricultural machinery which venture off made roads, will occasionally become bogged or stuck in mud or in soft sand.

While many such vehicles have powerful winches which might be used to winch the vehicle to safe ground, it is necessary to attach a cable of such a winch to a relatively immovable object so that the winch has something to act against.

However in so terrains it may be difficult, if not almost impossible, to find a relatively immovable object at sufficiently close proximity to be useful.

Accordingly, the present invention seeks to provide a device which might be used for debogging a vehicle.

SUMMARY OF THE INVENTION

In accordance with the present invention, therefore, there is provided an anchor comprising: an elongate, substantially cylindrical member; two substantially triangular shaped plate members adapted to be pivotally mounted on or to said elongate member whereby to be selectively and pivotally movable relative to said elongate member between a first storage position, wherein said plate members abut or overlie one another, and a second in-use position, in which said plate members extend away from one another; a shank attached to said elongate member and adapted to extend substantially parallel thereto; and a further member attached to said elongate member, and operatively connected to said shank, said further member acting as a carrying means for said anchor and as a handle or control means to assist in ground-engagement thereof.

There may be retaining means for releasably retaining the plates in said second position.

The triangular plates may have holes in them. Such holes are useful in allowing water and/or sand or mud flow from one side of the anchor to another and may also be useful to create a handhold for carrying the anchor when the triangular plates overlie one another A shank for the anchor may be provided.

The shank is preferably inclined at an angle of from 10°–30° to said axis, more preferably from 10°–20° and most preferably about 15°.

The shank may be releasably attachable to the anchor.

Bolts may be provided for releasably bolting the shank to the anchor.

The shank may be non-pivotable with respect to the anchor.

The trailing end of the anchor is preferably provided with plates which can be weighted or struck or stood upon to drive the anchor into the ground.

The trailing end of the anchor may be provided with handles or tie points to assist in retrieval of the anchor.

The pivotal mounting means may be a substantially circular bar or tube on which sleeves are mounted and at least one of the plates is mounted to the sleeves The bar or tube preferably has a pointed ground-engaging end. The bar or tube preferably carries a retrieval ring.

A handle or the like means may be provided for guiding the anchor in entering the ground. The guiding is preferably done at an end away from the ground-entering end. That handle may fold and, in folded condition, function as carrying means or handle. The handle preferably can be releasably attached to the shank in the folded condition, such attachment being preferably by means of a linkage.

The handle preferably carries latch means for releasably holding the plates in a first, not-in-use or storage position.

Preferably there is a foot which will raise the trailing end of the anchor with respect to the ground-entering end, so as to promote ground entry.

In order that the invention may be more clearly understood and put into practical effect there shall now be described in detail a preferred embodiment of an anchor in accordance with the invention. The ensuing description is given by way of non-limitative example only and is with reference to the accompanying drawings.

INTEGER LIST

Figure 1:
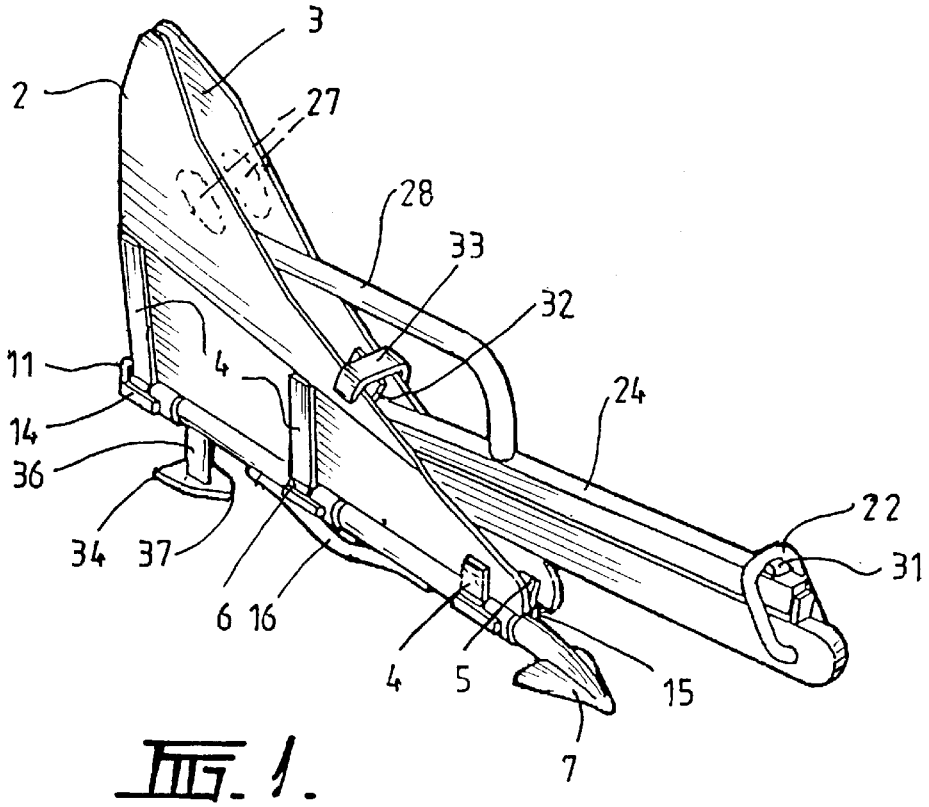
FIG. 1 is a perspective view of an anchor in accordance with the present invention in its closed, not-in-use or storage condition.

1. Ground anchor
2. First triangular plate
3. Second triangular plate
4. Tabs
5. Tabs
6. Sleeves
7. Triangular point
8. Sleeves
9. Rod
11. U-shaped shackle
14. Abutments
15. Abutments
16. First carry handle
17. Plates
18. Pivot pin
21. Shank
22. Ring
23. Arm
24. Guide handle
26. Pivot Pin
27. Apertures
28. Second carry handle
29. Footplates
31. Abutments
32. Plate
33. Latch
34. Foot
36. Leg
37. End

DESCRIPTION OF THE PREFERRED EMBODIMENT(S)

The ground anchor 1 shown in the drawings comprises a first substantially triangular plate 2 and a second substantially triangular plate 3, such triangular plates 2 and 3 being mounted, via tabs 4 and 5 to sleeves 6 and 8 which in turn are pivotally mounted on a substantially circular elongate rod 9.

The triangular plates 2 and 3 preferably have included angles of approximately 30°, 60° and 90°. The plates 2 and 3 carry footplates, generally designated 29, extending along at least part of the length of one side thereof.

The plates 2 and 3 optionally have apertures 27 (shown in dotted line) which are useful in breaking vacuum when the anchor is to be retrieved.

The elongate rod 9 carries a substantially triangular-shaped ground entering point 7 at one end thereof and a U-shaped shackle 11 at the other end.

Figure 2:
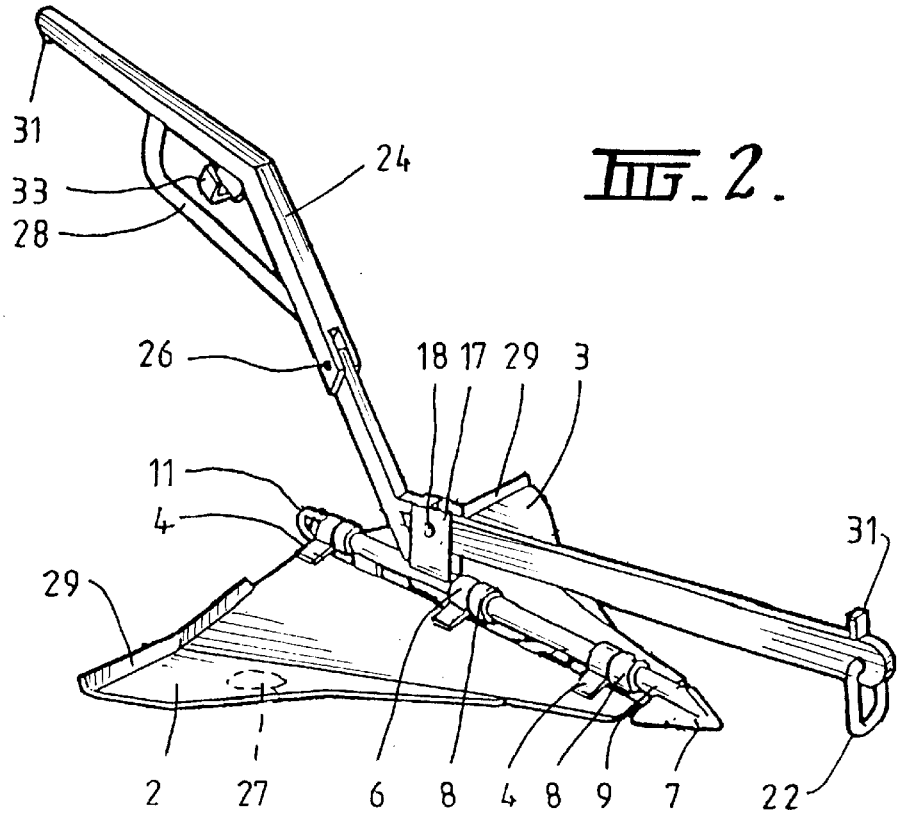
FIG. 2 is a perspective view of the anchor of FIG. 1 in its open or in-use condition.
Figure 3:
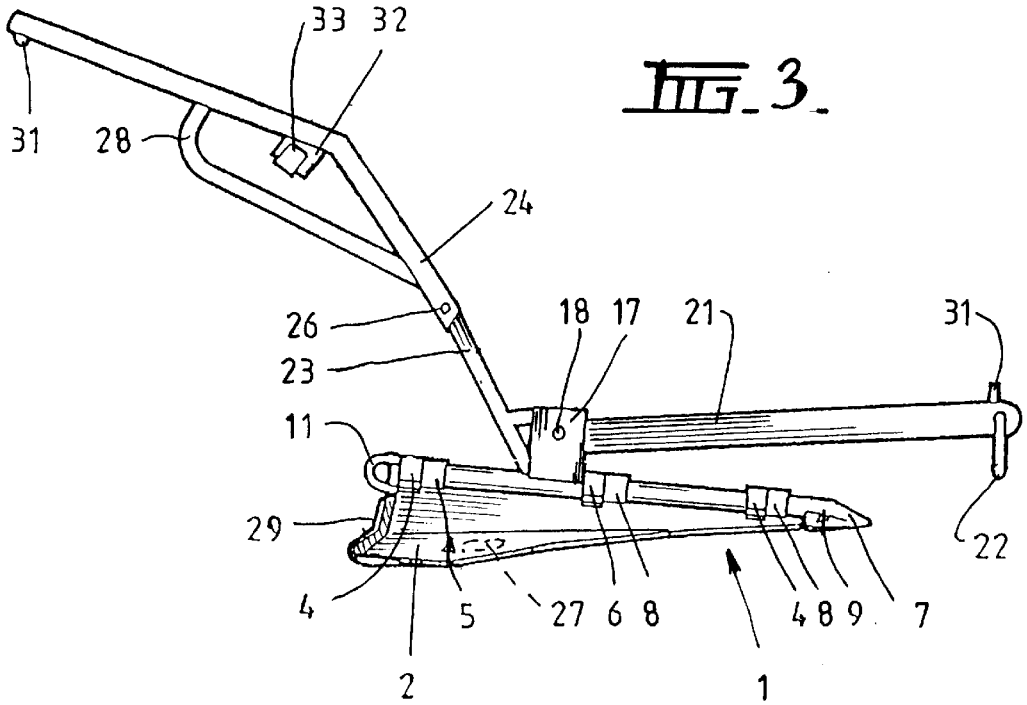
FIG. 3 is a side elevational view of the anchor of FIG. 2.
Figure 4:
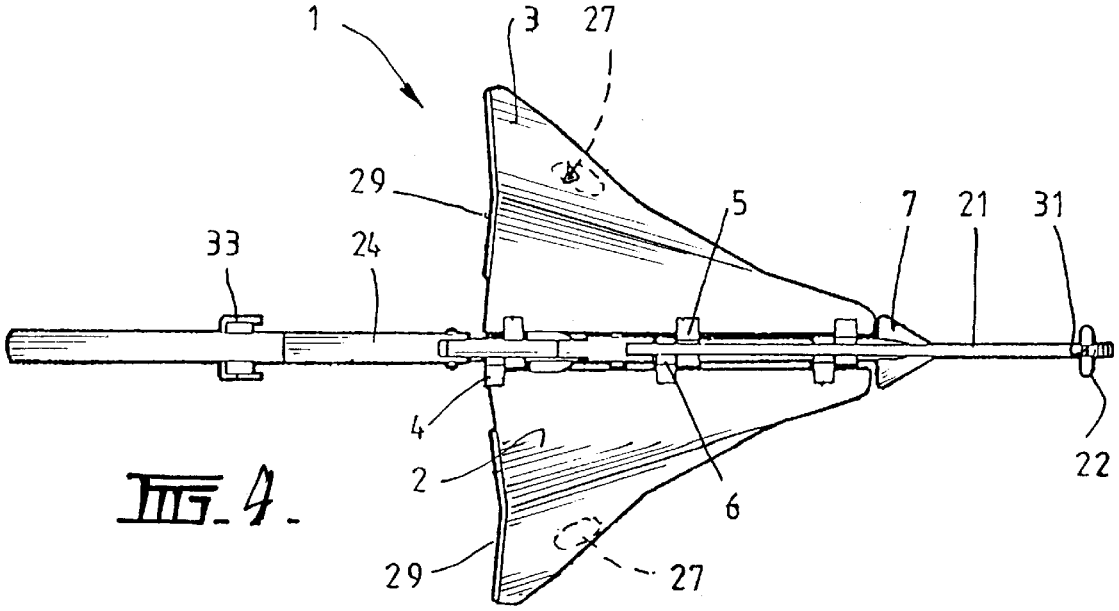
FIG. 4 is a top plan view of the anchor of FIG. 2.

The sleeves 6 and 8 carry abutments 14 and 15 which will come in to abutment when the plates 2 and 3 are in the condition shown in FIG. 2, whereby to limit rotation of the plates 2 and 3 about the rod 9.

In one preferred embodiment, as shown in FIG. 1, on the underside of the anchor there is provided a first carrying means, in the form of handle 16, which is a length of bent rod secured in any known manner, as for example by welding to the rod 9.

Plate members 17 are secured on the upper side of rod 9, such plates 17 supporting a pivot pin 18 which carries a shank 21 at or in the vicinity of the free end of which a ring 22 is fitted, preferably releasably.

Secured to the rod 9 and plate members 17 is an arm 23 to which a guide handle 24 is pivotally attached by means of a pivot pin 26

A second carrying means, again in the form of a handle and designated 28, is attached to the guide handle 24. The guide handle 24 also has an abutment 31. Further, the guide handle 24 also has an upstanding plate 32 which carries a U-shaped latch 33.

A foot 34 is preferably attached to a leg 36 which in turn is attached to the rod 9, and extends downwardly therefrom. The foot 34 is pointed at one end 37.

From the open position shown in FIG. 2, which is the position for use as an anchor, the anchor 1 can be folded for carrying and storage by lifting the plates 2 and 3 so that they come to the orientation shown in FIG. 1. The guide handle 24 may be lowered to the position shown in FIG. 1, in so doing, ensuring that the U-shaped latch 33 engages with and holds the plates 2 and 3 against reverting to the FIG. 2 position. The ring 22 is then passed over the abutment 31 to secure the guide handle 24 to the shank 21.

Thereafter either the first carry handle 16 or the second carry handle 28 may be used to carry the anchor 1.

The anchor 1 may be returned to the FIG. 2 position by releasing the ring 22 from the abutment 31 and by lifting the guide handle 24, which will enable the release of the plates 2 and 3 to revert to the FIG. 2 position.

It is to be noted that the foot 34 and leg 36 serve to give the anchor a tilt of about 5°–20° which will aid ground penetration.

The guide handle 24 can be used by a user to guide and direct the anchor as it penetrates the ground.

The footplates 29 may be stood on by a user to help drive the anchor into the ground or, alternatively, the footplates may be struck by a heavy hammer or other weight to help drive the anchor into the ground.

The anchor 1 described above has been found to be effective in soft ground, mud and sand as providing a useful anchoring point in assisting in debogging of vehicles.

Finally it is to be understood that various alterations, modifications and or additions may be incorporated into the various constructions and arrangements of parts without departing from the spirit of the invention, the scope of which is to be determined from the following claims.

I claim:

1. An anchor comprising: an elongate, substantially cylindrical member; two substantially triangular-shaped plate members pivotally mounted on or to said elongate member whereby to be selectively and pivotally movable relative to said elongate member between a first storage position, wherein said plate members abut or overlie one another, and a second in-use position, in which said plate members extend away from one another; a shank attached to said elongate member and extending substantially parallel thereto; and a further member attached to said elongate member, and operatively connected to said shank said further member acting as a carrying means for said anchor and as a handle or control means to assist in ground-engagement thereof.

2. The anchor as claimed in claim 1, wherein said further member has one fee end portion thereof pivotally movable relative to the remainder of said further member between said first position, wherein said free end portion of said further member abuts with or overlies said shank, thereby to provide a carrying means for said anchor, and said second position, wherein said further member extends substantially upwardly from the said elongate member and shank.

3. The anchor as claimed in claim 2, including means for pivotally mounting said plate members to said elongate member, said mounting means comprising one or more sleeves or collar members rotatably mounted on said elongate member, and wherein said plate members are attached to the or selected ones of said sleeves or collar members.

4. The anchor as claimed in claim 3, wherein said elongate member includes, at one end thereof, a substantially triangular-shaped end portion adapted to assist in ground-engagement of said anchor.

5. The anchor as claimed in claim 4, including means for attaching said free end portion of said further member to said shank when said free end portion is in said first position.

6. The anchor as claimed in claim 5, wherein said further member includes latch means for releasably holding said plate members in said first position.

7. The anchor as claimed in claim 6, wherein said shank is attached to at least one support member fixedly attached to said elongate member, said shank being pivotally movable relative to said elongate member around a pivot pin supported by said at least one support member.

8. The anchor as claimed in claim 7, wherein said further member is fixedly attached, at one end thereof, to said elongate member at or in the vicinity of where said shank is attached to said elongate member, said further member being made up of two distinct and relatively movable portions.

9. The anchor as claimed in claim 8, wherein each plate member includes at least one aperture extending therethrough.

10. The anchor as claimed in claim 9, wherein said elongate member includes, at the other end thereof, a shackle.

11. The anchor as claimed in claim 10, wherein said plate members are mounted on said elongate member by one or more sleeves extending therefrom.

12. The anchor as claimed in claim 11, wherein said elongate member has one or more abutment means associated therewith, whereby to limit the extent of rotation of said plate members relative to said elongate member.

13. The anchor as claimed in claim 12, wherein said shank includes, at the free end thereof, means for retaining said further member in abutment therewith when said anchor is in said storage position.

14. The anchor as claimed in claim 13, wherein said retaining means is in the form of a ring, disposed at or in the vicinity of the free end of said shank, co-operable with a protrusion disposed at or in the vicinity of said free end of said further member.

15. An anchor comprising: two generally triangular plates; pivotal mounting means which mount an edge of one of said two plates to an edge of the other of said two plates, whereby said plates can be pivoted about an axis from a first position to a second position in which they extend from one another; a handle for guiding the anchor into the ground and for being folded to a position where it can be used as a carry handle; a shank for applying drawing loads to the anchor; and, means for attaching said handle to said shank when said handle is in said folded position.

16. The anchor of claim 15 wherein said handle carries latch means for releaseably holding said plates in said first position.

* * * * *

UNITED STATES PATENT AND TRADEMARK OFFICE

CERTIFICATE OF CORRECTION

PATENT NO. : 5,850,715
DATED : December 22, 1998
INVENTOR(S) : Rex William Francis It is certified that error appears in the above-indentified patent and that said Letters Patent is hereby corrected as shown below:

Title page, item [57],
In the Abstract, line 05, "relate" should be --relative--;
Column 01, line 26, "so" should be --some--;
Column 04, line 26, "fee" should be --free--.

Signed and Sealed this
Sixteenth Day of November, 1999

*Attest:*

*Attesting Officer*

Q. TODD DICKINSON

*Acting Commissioner of Patents and Trademarks*